US005492308A

United States Patent [19]

Yao et al.

[11] Patent Number: 5,492,308

[45] Date of Patent: Feb. 20, 1996

[54] CONSTRAINED QUENCHING APPARATUS AND HEAT TREATMENT APPARATUS

[75] Inventors: Yugo Yao; Yoshiki Seto, both of Hiratsuka; Junichi Kato, Yokohama, all of Japan

[73] Assignee: Neturen Co., Ltd., Tokyo, Japan

[21] Appl. No.: 295,727

[22] PCT Filed: May 28, 1993

[86] PCT No.: PCT/JP93/00721

§ 371 Date: Aug. 26, 1994

§ 102(e) Date: Aug. 26, 1994

[87] PCT Pub. No.: WO94/14985

PCT Pub. Date: Jul. 7, 1994

[30] Foreign Application Priority Data

Dec. 28, 1992 [JP] Japan ..... 4-358645

[51] Int. Cl.[6] ..... C21D 1/673

[52] U.S. Cl. ..... 266/117; 148/646; 266/259

[58] Field of Search ..... 266/117, 114, 266/259; 148/646, 647

[56] References Cited

U.S. PATENT DOCUMENTS 3,506,501 4/1970 Hays et al. ..... 148/131

FOREIGN PATENT DOCUMENTS 49-39368 10/1974 Japan .
64-28304 1/1989 Japan .

*Primary Examiner*—Scott Kastler
*Attorney, Agent, or Firm*—Wenderoth, Lind & Ponack

[57] ABSTRACT

A constrained quenching apparatus is provided for hardening a workpiece such as an asymmetrical bar which has a notable tendency to warping when quenched, without warping the workpiece. The apparatus comprises a set of two or more dies having plural projections provided on the inner side thereof, the projections coinciding with the contour of the workpiece when the dies are closed so that their die faces in contact with one another, and having plural recesses therein defined by the projections. The recesses are provided with one or more cooling liquid blow holes. The apparatus does not exert pressure on the workpiece at the start of the quenching when the workpiece is soft, so the flattening of the hollow workpiece such as a pipe, can be prevented.

10 Claims, 5 Drawing Sheets

CONSTRAINED QUENCHING APPARATUS AND HEAT TREATMENT APPARATUS

FIELD OF THE INVENTION

The present Invention relates to a constrained quenching apparatus for hardening a workpiece, e.g. a round bar, without warping and to a heat treatment apparatus employing that apparatus. The present invention is directed towards quenching of an asymmetrical workpiece which has a notable tendency to warping and of a hollowed workpiece which is difficult to deal with using a conventional quenching apparatus.

BACKGROUND ART

Many machinery components having a round bar shape are subjected to a hardening process. When the component is symmetrical about a center axis, it is usually rotated about the axis during quenching to prevent warping. If the workpiece is asymmetrical about its center axis, such as a round bar component having a flat side extending, therealong, it tends to warp due to inconsistency in the cooling rate. To prevent warping during quenching of such an axially asymmetrical component, a press quenching method which provides constrained quenching is commonly utilized. In the press quenching method, all or a part of a workpiece is securely held at a pressure in a set of dies having inside walls adapted to match and is accommodate the shape of the workpiece, and cooled down by thermal dissipation throughout the dies or direct by immersion into a cooling liquid. In the case of thermal dissipation throughout the dies, the cooling of the workpiece is effected through the dies which are directly cooled by liquid.

Recently, tubular shaped components tend to be adopted used in place of the traditional solid bars in machinery especially in automobiles, for minimizing the overall weight of the products. However, in the conventional press quenching method, the tubular workpiece is easily collapsed due to it hollow being and being softened by heat.

The press quenching method hardly allows the cooling speed to be controlled in desired locations. The quenching strain on the workpiece is a combination of a thermal strain and a phase transformation strain which is varied depending on the phase transformation. Consequently the quenching strain does not depend on only the cooling rate, but also depends on the chemical composition of the material. Nevertheless, if the cooling rate is locally controlled, the warping of the asymmetrical workpiece can be suppressed to a certain degree in an early stage of the warping. Moreover, if cooling rate is changed locally, the resultant hardness of a target region of the workpiece will be adjusted in combination with the heating temperature to almost a desired value so as to provide a favorable material characteristic.

SUMMARY OF THE INVENTION

It is an object of the present invention to provide a constrained quenching apparatus capable of quenching a tubular workpiece without warping or collapsing the workpiece, to provide a quenching apparatus where the cooling rate can be controlled locally on the workpiece, and to provide a heat treatment apparatus for quenching and tempering required parts of machinery components efficiently. The constrained quenching apparatus according to the present invention comprises a set of two or more dies disposed on a pressing means. The dies have plural projections provided on the inner side thereof, the projections coinciding with the contour of a workpiece when the dies are closed and the die faces are in contact, and have plural recesses therein defined by the projections for communicating with one another and which extend to the outside of the dies. One or more of the recesses in at least one of the dies is provided with one or more cooling liquid blow holes.

Preferably, plural cooling liquid blow holes are provided the each die, and a flow controlling means is fitted into each of the cooling liquid blow holes for determining the amount of cooling liquid flow. The dies can be constructed by cutting recesses into inner walls of the blocks so that projections formed between the recesses coincide with the contour of the workpiece, or by mounting separate projections to inner walls of blocks, the inner dimensions of inner walls being larger than the outer dimensions of the outer contour of the workpiece. The heat treatment apparatus according to the present invention comprises an induction heater arranged close with the foregoing constrained quenching apparatus so that the workpiece can travel in the same height.

DETAILED DESCRIPTION OF THE INVENTION

Figure 1:
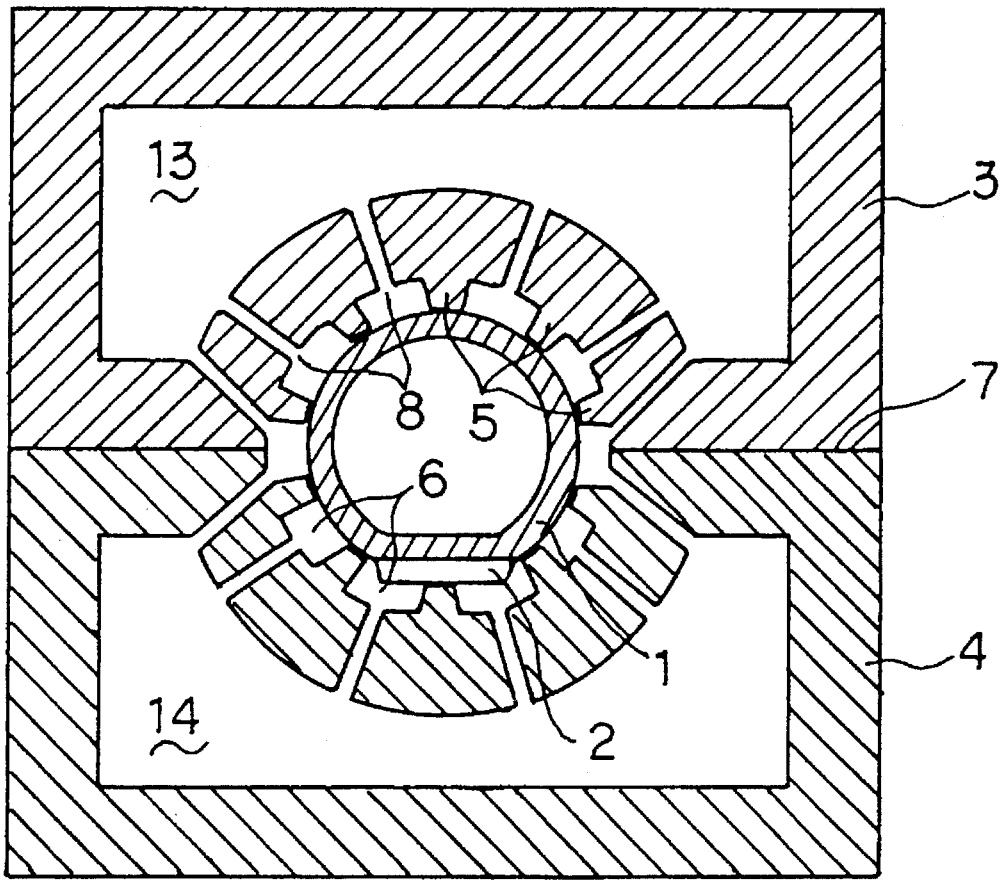
FIG. 1 is a cross-sectional view of a set of dies in which a workpiece is accommodated, showing a principal part of a constrained quenching apparatus of the present invention.
Figure 2:
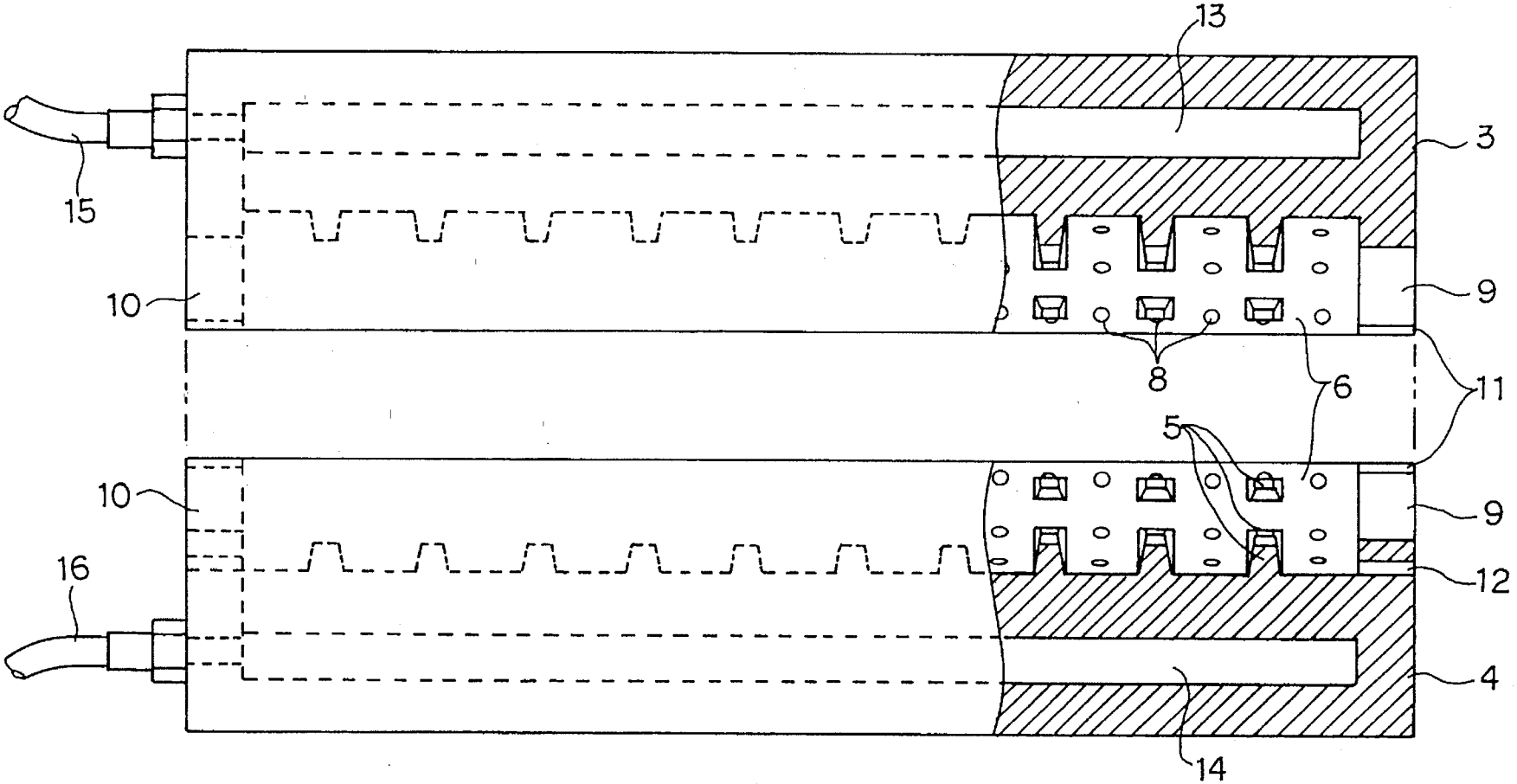
FIG. 2 is a partially cross-sectional side view of the upper and lower dies of FIG. 1 when.
Figure 3:
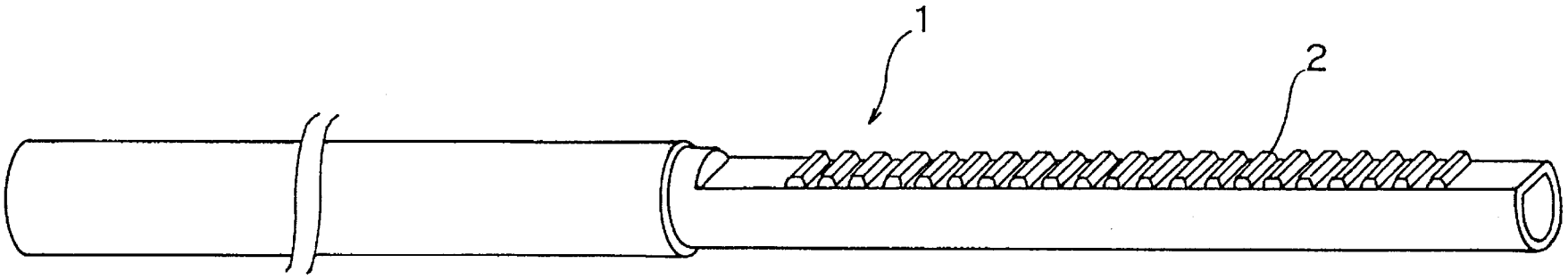
FIG. 3 is a perspective view of an exemplary form of the workpiece to be treated by the apparatus of the present invention.

The present invention will be described in more detail referring to the accompanying drawings. FIG. 3 is a perspective view of a workpiece 1, having a rack 2 which is provided on an outside of a hollow tube thereof and which is to be constrain quenched with the use of the apparatus according to the present invention. FIGS. 1 and 2 illustrate a die set which is a main part of the constrained quenching apparatus for quenching the rack 2 of the workpiece 1 shown In FIG. 3. More particularly, FIG. 1 is a cross-sectional view showing the workpiece held between two, upper and lower, dies. FIG. 2 is a partially cross-sectional side view of the apparatus explaining its open state with the upper and lower dies separated and the workpiece removed.

It is intended in the apparatus of the present invention that when the two dies 3 and 4 are closed so as to touch each other at the die faces 7 which act as contact surfaces and function to prevent pressure from being exerted, on the workpiece at the beginning of the quenching. More specifically, the dies have plural projections 5 arranged on the inside thereof to coincide with the contour of the workpiece, as shown in FIG. 1. As the dies are closed, the projections come to lightly touch or to be very slightly spaced from the surface of the workpiece. The dies also have recesses 6 therein, which are defined by the projections 5 and into which liquid blow holes 8 open. Each of the upper and lower dies has a cavity 13 and 14 respectively therein which leads to the liquid blow holes 8. A detachable plug having a sized orifice therein (not shown) is screwed into each of the liquid blow holes 8 for delivering a predetermined amount of cooling liquid.

As shown in FIG. 2, each of the dies 3 and 4 has a couple of wide openings 9 and 10 at both ends thereof so that the workpiece, which is greater in length than the dies 3 and 4, can be held and quenched. As described previously, the inner sides of the dies are provided with the projections 5 and the recesses 6 communicating with liquid blow holes 8. Flows of the cooling liquid from the liquid blow holes are introduced into the recesses and discharged to the outside from outlets 11 provided at a longitudinal end between the dies and the workpiece. The lower die 4 has drain passages 12 opening into the bottom of the recesses thereof for discharging remainding of the cooling liquid. Extra outlets may also be provided along the circumference of the workpiece or at other locations for ease of discharging the liquid from the recesses. The cavities 13 and 14 of the dies 3, 4 are communicated with liquid supply conduits 15 and 16, respectively.

As described above, the apparatus carries out constrained quenching without the risk of deformation of a hollow workpiece, because the workpiece is not compressed by the dies. Although stress will be exerted on the workpiece when it is caused to warp due cooling, the hardness of the workpiece has already been increased so that the surface thereof will not be depressed. As compared with the prior art where a considerable pressure is exerted to the workpiece at the beginning of the quenching, the apparatus of the present invention imparts no such constraining pressure to the workpiece at the start of the quenching, but allows such constraining force to be present only if the workpiece is cause driven to warp due to cooling.

The apparatus of the present invention can also reduce the warping by changing the cooling speed locally by adjusting the location and size of the liquid blow holes and the locations of the projections. This eliminates the root cause of warping to some extent before the occurence of warping, so it is favorable from the standpoint of reducing residual stress. Furthermore, the degree and depth of hardness of the workpiece may be selectively be adjusted by adjusting the cooling rate locally in combination with the heating conditions.

Although it is accepted in this invention that at least one liquid blow hole is provided in each of the upper and lower dies, allocation of the liquid blow holes will give a desirable change in the quenching rate. For example, the cooling is faster where a blast of the cooling liquid from the liquid blow hole is directly applied and rather moderate where a flow of the cooling liquid is dissipated through the recesses. For prevention of warping of the workpiece, which is the aim of this invention, the projections must be arranged in appropriate locations, but they may also be used for changing the cooling rate because their direct contact with the workpiece over large areas can retard the cooling effect.

The cooling speed may also be controlled with the use of flow regulating means for determining the flow of the cooling liquid from each of the liquid blow holes. The means comprise flow control values disposed at their respective liquid blow holes or as mentioned before, plugs having different sized orifices therein, the plugs being screwed into their respective holes. In the latter case, the required size of the orifices in the plugs can be identified through a trial quenching process.

The dies for the apparatus of the present invention may be constructed by cutting the recesses into inner walls of blocks so at to coincide with the contour of a workpiece and such that each of the dies and the projections protruding therefrom comprises an integral unitary body, or by mounting separate projections to the inner walls of blocks where the inner wall is larger than the contour of the workpiece. The method of producing the dies is not limited to forming the recesses or attaching the projections, so long as the recesses are communicated with one another for readily discharging the cooling liquid supplied from the liquid blow holes.

The previous embodiment of the present invention has been described as utilizing, upper and lower dies, but so long as far as one set of dies can be divided into plural dies, the number of dies is not important. An exemplary arrangement of utilizing three separate dies will now be explained.

Figure 4:
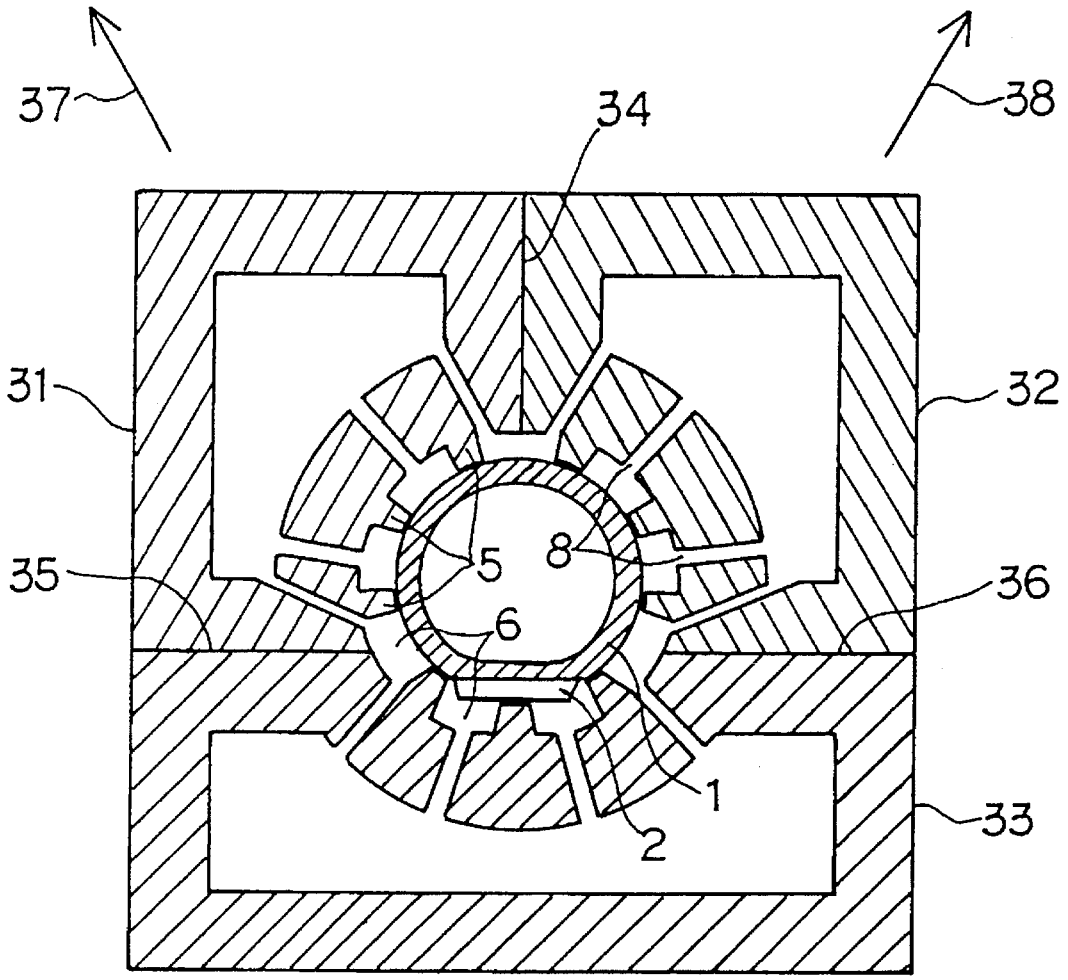
FIG. 4 is a cross-sectional view of another set of dies where a workpiece is accommodated, similar to FIG. 1, according to the present invention.

FIG. 4 is a cross-sectional view, similar to FIG. 1, showing a set of dies with the workpiece shown in FIG. 3 held therein. This die set consists of the three dies 31, 32, and 33 which have projections 5 provided on the inner side thereof to match the contour of the workpiece when die faces 34, 35 and 36 are adjoined. The other structural arrangements in FIG. 4 are identical to those shown in FIG. 1.

The advantage of the three-die set is that the two upper dies 31 and 32 can be moved obliquely upwards as denoted by the arrows 37, 38 in FIG. 4 for case of loading and unloading of the workpiece, as compared with the two-die set of FIG. 1. In the two-die set, when the two dies are separated in vertical movement, inner edge portions have to slide parallel to the outside of the workpiece causing the removal of the workpiece to be sometimes difficult. This problem is eliminated in the three-die set shown in FIG. 4. The three-die set is preferable over the two-die set for hardening, at high efficiency, a number of workpieces even if the workpieces have a relatively simple tubular shape, although its price is higher than the two-side set. It is understood that if the workpiece has an intricate shape, the die set must be correspondly designed as to the number of dies in one set and the location of separations.

Figure 5:
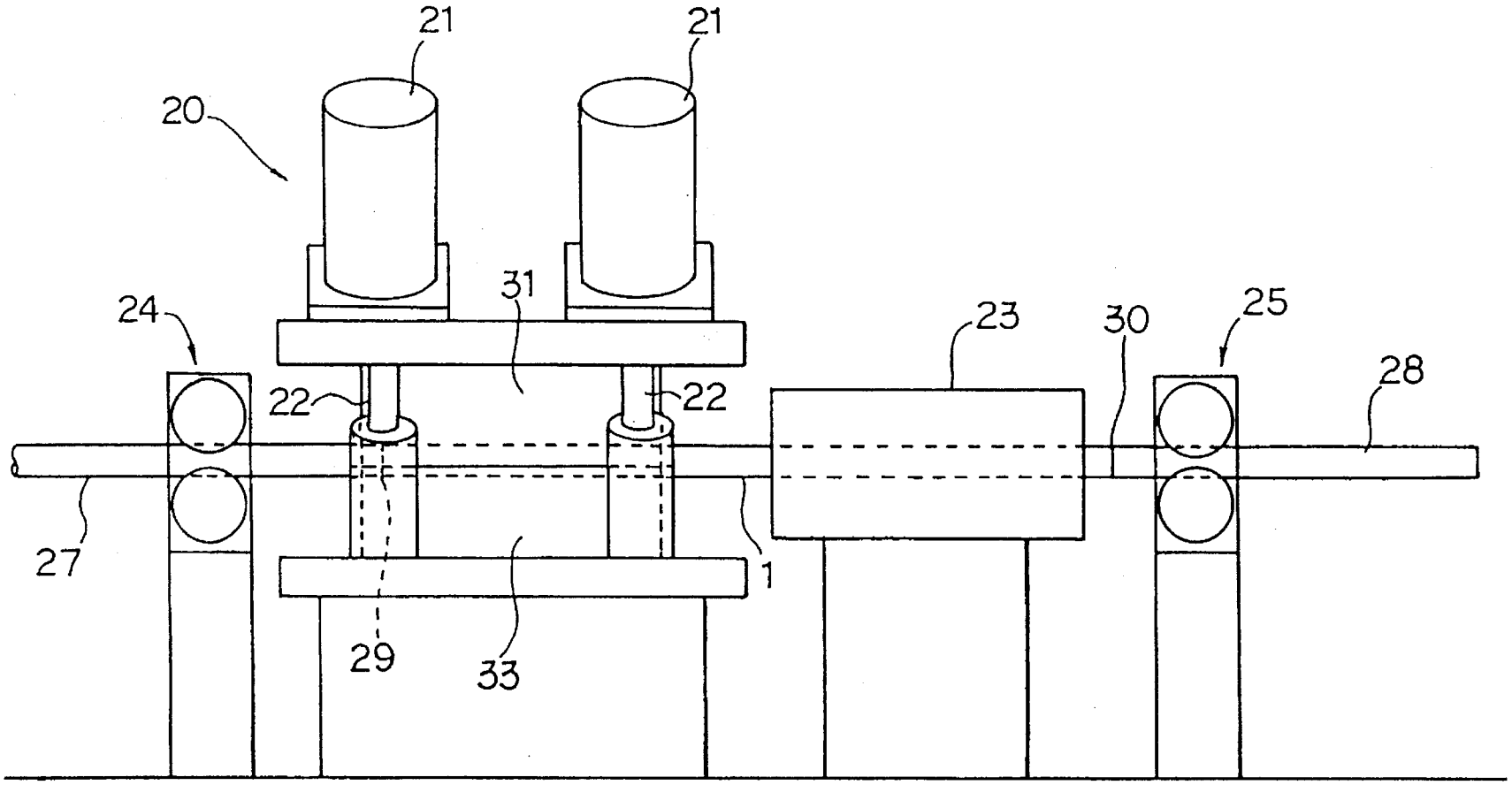
FIG. 5 is a side view of a heat treatment apparatus according to the present invention.

The constrained quenching apparatus of the present invention comprises the dies, shown in FIGS. 1, 2, and 4, accompanied with a pressing means. FIG. 5 illustrates the above composition and also the entire arrangement of the apparatus constituting a heat treatment apparatus of the present invention. As shown, the constrained quenching apparatus denoted by 20 has a set of the dies of FIG. 4 actuated by a hydraulic pressing mechanism. The hydraulic pressing mechanism comprises a pair of hydraulic cylinders 21 provided for moving the die 31 up and down, the die being joined to piston rods 22 of the cylinders 21. More particularly, the cylinders 21 with the piston rods 22 are mounted at an angle for moving the die 31 upward in a slanting direction. Another pair of cylinders are also mounted opposite to the two cylinders 21 for moving the die 32 of FIG. 4 up and down in a slanted direction. The die 32 is not shown in FIG. 5 but is present on the far side of the die 31. The pressing means is not limited to the hydraulic mechanism of FIG. 5, but can be any other suit-able means, e.g. a mechanical actuator powered by an electric motor.

An especially efficient heat treatment apparatus can be set up by disposing an induction heater 23 adjacent to the constrained quenching apparatus 20, as shown in FIG. 5. As for the heating device, rapid heat-up type of heating device is favorable for work efficiency, so the induction heater for heating the whole circular cross section of a bar-shaped workpiece is especially preferable for use with the constrained quenching apparatus of the present invention.

More preferably, the induction heater 23 is arranged close to the constrained quenching apparatus 20 so that the workpiece 1 can travel at a constant height, as shown in FIG. 5. If the workpiece 1 is a round bar, that is attained by arranging the apparatus so that the workpiece can travel in its axial direction. Sets of rollers 24 and 25 in FIG. 5 are provided for feeding the workpiece axially. In order to harden a part of the bar workpiece, the workpiece is heated for a desired length and then fed into the constrained quenching apparatus by the rollers. In order of temper using the same induction heater, the workpiece can be easily returned thereto.

Moreover the feeding is made easier by adding extensions to one end or both ends of the workpiece. Particularly, when the entire workpiece is to be heated, it can be smoothly set at a position by manipulating the extension(s). Such extensions 27 and 28 are connected at junctions 29 and 30 respectively to the workpiece 1 as shown in FIG. 5. The extensions may be either a solid or tubular bar which is joined to the workpiece detachably such as by a threaded screw.

The result of an experimental hardening operation using with the apparatus of the present invention will now be explained. The experimental operation was carried out so that the workpiece 1 having the rack 2 on a longitudinal portion of the tubular body as shown in FIG. 3 was heat treated with the heat treatment apparatus of the present invention shown in FIG. 5. The hardening was applied to not only teeth of the rack 2 but also a corresponding circumference of the tubular body. The workpiece was 23 mm in outer diameter and 19 mm in inner diameter at the segmented-circle cross-section of the rack portion, and 300 mm in length, where the actual rack length was 180 mm. In addition, the region of full-circle cross-section at the left in FIG. 3 had an outer diameter of 25 mm, an inner diameter of 21 mm and a length of 450 mm. The material of the workpiece was carbon steel for machine structural use equivalent to JIS S40C.

The workpiece 1 was heated by the high-frequency induction heater 23 to about 860° C. and quenched with water by the constrained quenching apparatus of the present invention. The workpiece 1 was connected with the extensions 27 and 28 which are the same in crosssection as the workpiece for ease of handling. After the processing, the deflection (maximum deviation from the center axis) of the workpiece was as low as 0.02 to 0.05 mm for a length of 200 mm. Those measurements are small enough to be negligible. It was also found that no partial dent was present on the surface and no flattening of the tubular body occurred. For comparison, the conventional quenching process which involved uniformly cooling the workpiece with water without constraint resulted in 2.0 to 3.2 mm of deflection.

As set forth above, the constrained quenching apparatus of the present invention exerts no pressure at the start of the quenching, but provides the constraining force only if the workpiece is caused to warp by the cooling down thereof. Accordingly, a hollow workpiece such as a tube can be prevented from undergoing quenching strains which cause deformation such as flattening. The flow of a cooling liquid is controlled based on the size and location of the workpiece, thereby also preventing warping and moreover controlling physical characteristics of the workpiece. The heat treatment apparatus of the present invention permits heating of the workpiece at a higher efficiency. The steps of heating, quenching and tempering can readily be carried out in succession while the transfer of workpieces from one step to another is increased in speed.

We claim:

1. A quenching apparatus comprising:

at least two dies removably mounted to one another, said at least two dies having inner surfaces which together define a workpiece cavity;

a plurality of projections protruding inwardly from said inner surfaces of said at least two dies and defining a contour corresponding to a contour of a workpiece;

wherein recesses are defined between said projections;

wherein cooling liquid blow holes are formed in said at least two dies and open into said recesses; and wherein said at least two dies further include contact surfaces, respectively, for contacting one another when said at least two dies are mounted to one another, said contact surfaces constituting means for preventing substantial pressure from being exerted against the workpiece by said projections and for causing said projections to constrain the workpiece to prevent warping of the workpiece.

2. A quenching apparatus as recited in claim 1, wherein said at least two dies comprise a lower die and first and second upper dies, said upper dies being respectively separable from said lower die in directions slanting upwardly and outwardly away from said lower die.

3. A quenching apparatus as recited in claim 1, further comprising a cooling liquid-flow control device fitted into each of said cooling liquid blow holes.

4. A quenching apparatus as recited in claim 1, wherein each of said at least two dies and the ones of said projections protruding therefrom comprise an integral unitary body.

5. A quenching apparatus as recited in claim 1, wherein said projections are discrete members which are mounted to said dies, respectively.

6. A heat treatment apparatus comprising an induction heater disposed along a workpiece travel path, and a quenching apparatus disposed along the workpiece travel path and at substantially the same height as said induction heater, said quenching apparatus comprising:

at least two dies removably mounted to one another, said at least two dies having inner surfaces which together define a workpiece cavity;

a plurality of projections protruding inwardly from said inner surfaces of said at least two dies and defining a contour corresponding to a contour of a workpiece;

wherein recesses are defined between said projections;

wherein cooling liquid blow holes are formed in said at least two dies and open into said recesses; and wherein said at least two dies further include contact surfaces, respectively, for contacting one another when said at least two dies are mounted to one another, said contact surfaces constituting means for preventing substantial pressure from being exerted against the workpiece by said projections and for causing said projections to constrain the workpiece to prevent warping of the workpiece.

7. A heat treatment apparatus as recited in claim 6, wherein said at least two dies comprise a lower die and first and second upper dies, said upper dies being respectively separable from said lower die in directions slanting upwardly and outwardly away from said lower die.

8. A heat treatment apparatus as recited in claim 6, wherein said quenching apparatus further comprises a cooling liquid-flow control device fitted into each of said cooling liquid blow holes.

9. A heat treatment apparatus as recited in claim 6, wherein each of said at least two dies and the ones of said projections protruding therefrom comprise an integral unitary body.

10. A heat treatment apparatus as recited in claim 6, wherein said projections are discrete members which are mounted to said dies, respectively.

* * * * *

UNITED STATES PATENT AND TRADEMARK OFFICE

CERTIFICATE OF CORRECTION

PATENT NO. : 5,492,308

DATED : February 20, 1996

INVENTOR(S) : Yugo YAO et al.

It is certified that error appears in the above-identified patent and that said Letters Patent is hereby corrected as shown below:

Column 1, line 21, delete "," between "extending" and "therealong";

line 28, delete "is" between "and" and "accomodate";

line 29, insert --is-- between "and" and "cooled";

line 30, change "direct by" to --by direct--;

line 34, delete "adopted";

line 39, change "hollow being" to --being hollow--;

line 44, insert --temperature-- after "transformation";

Column 2, line 27, insert --open-- after "when";

line 57, delete "," between "exerted" and "on";

Column 3, line 9, insert --the-- between "with" and "liquid";

line 25, insert --to-- between "due" and "cooling";

line 33, change "cause driven" to --caused--;

line 36, change "location" to --locations--;

UNITED STATES PATENT AND TRADEMARK OFFICE

CERTIFICATE OF CORRECTION

PATENT NO. : 5,492,308

DATED : February 20, 1996

INVENTOR(S) : Yugo YAO et al.

It is certified that error appears in the above-indentified patent and that said Letters Patent is hereby corrected as shown below:

Column 3, line 41, delete "be" between "selectively" and "adjusted";

line 59, change "comprise" to --comprises--;

line 59, change "values" to --valves--;

Column 4, line 1, change "at" to --as--;

line 11, delete "," between "utilizing" and "upper";

line 12, delete "as far";

line 24, change "case" to --ease--;

line 36, change "correspondly" to --correspondingly--;

line 56, change "suit-able" to --suitable--;

line 61, insert --a-- before "rapid";

UNITED STATES PATENT AND TRADEMARK OFFICE

CERTIFICATE OF CORRECTION

PATENT NO. : 5,492,308
DATED : February 20, 1996
INVENTOR(S) : Yugo Yao, et. al.

It is certified that error appears in the above-indentified patent and that said Letters Patent is hereby corrected as shown below:

Column 5, line 8, change "of" to --to--;
line 21, delete "with";

Signed and Sealed this

Twenty-third Day of September, 1997

*Attest:*

Bruce Lehman

BRUCE LEHMAN

*Attesting Officer*

*Commissioner of Patents and Trademarks*